US006373442B1

(12) United States Patent
Thomas et al.

(10) Patent No.: US 6,373,442 B1
(45) Date of Patent: Apr. 16, 2002

(54) ANTENNA FOR A PARKING METER

(76) Inventors: David L. Thomas, 3010 Crater La., San Jose, CA (US) 95132; Bradley L. Gilbert, 1319 Benito Ave., Burlingame, CA (US) 94010; Lawrence W. Hickey, 2053 Oregon Ave., Redwood City, CA (US) 94061

( * ) Notice: Subject to any disclaimer, the term of this patent is extended or adjusted under 35 U.S.C. 154(b) by 0 days.

(21) Appl. No.: 09/378,539

(22) Filed: Aug. 20, 1999

Related U.S. Application Data

(63) Continuation-in-part of application No. 09/322,609, filed on May 28, 1999.

(51) Int. Cl.[7] ..... H01Q 1/24
(52) U.S. Cl. ..... 343/767; 343/700 MS
(58) Field of Search ..... 343/746, 745, 343/767, 768, 750, 700 MS, 769

(56) References Cited

U.S. PATENT DOCUMENTS

| | | | | | |
|---|---|---|---|---|---|
| 2,501,430 | A | | 3/1950 | Alford | 250/33 |
| 2,508,084 | A | | 5/1950 | Alford | 250/33 |
| 2,611,866 | A | | 9/1952 | Alford | 250/33 |
| 4,356,903 | A | | 11/1982 | Lemelson et al. | 340/51 |
| 4,819,003 | A | | 4/1989 | Goto et al. | 343/771 |
| 5,155,493 | A | | 10/1992 | Thursby et al. | 343/700 |
| 5,298,894 | A | | 3/1994 | Cerny et al. | 340/870.02 |
| 5,621,419 | A | | 4/1997 | Meek et al. | 343/770 |
| 5,710,743 | A | | 1/1998 | Dee et al. | 368/90 |
| 5,757,326 | A | * | 5/1998 | Koyama et al. | 343/767 |
| 5,903,520 | A | | 5/1999 | Dee et al. | 368/90 |
| 5,917,454 | A | | 6/1999 | Hill et al. | 343/769 |
| 6,014,105 | A | * | 1/2000 | Davis et al. | 343/767 |
| 6,034,644 | A | * | 3/2000 | Okabe et al. | 343/767 |
| 6,052,093 | A | * | 4/2000 | Yao et al. | 343/767 |

OTHER PUBLICATIONS

MeterVision System Information, internet address: www-.metervision.com, 4 pages.

* cited by examiner

*Primary Examiner*—Don Wong
*Assistant Examiner*—Wilson Lee
(74) *Attorney, Agent, or Firm*—Fish & Richardson P.C.

(57) ABSTRACT

A slot antenna is used to transmit radio frequency (RF) signals from within the housing of an electronic parking meter. The antenna is formed on a circuit board from a layer of conductive material from which some material has been removed to form a slot. A signal feed element, such as a coaxial cable terminating at a coaxial connector, connects electrically to the layer of conductive material on one side of the slot. A conductive element extends from the signal feed element across the slot to connect to the layer of conductive material.

15 Claims, 2 Drawing Sheets

ANTENNA FOR A PARKING METER

CROSS REFERENCE TO RELATED APPLICATIONS

This application is continuation-in-part of U.S. patent application Ser. No. 09/322,609, filed May 28, 1999.

TECHNICAL FIELD

This application relates to transmitting RF signals and, more particularly, to transmitting RF signals from a conductive enclosure, such as a parking meter.

BACKGROUND

Parking meters are an important source of revenue for many municipalities, but maintaining and monitoring the meters is a labor intensive process that consumes much of the revenue derived from the meters. Parking meters are also prone to vandalism and theft, which often leave the meters inoperable. In general, municipalities do not learn that parking meters are out of order, vandalized, or stolen until patrol or collection officers visit the meters. Enforcement of parking meter violations also requires a patrol officer to walk or drive within several feet of the meters so that the officer can read the meter displays. Many electronic parking meters include electronic processors that collect information about the meters, such as the amount of money stored in the meters and the time elapsed since the pay timers last expired.

SUMMARY

This application describes wireless transmission circuitry that transmits information from conductive enclosures, such as parking meter housings. This circuitry allows remote monitoring of monetary collection units, such as parking meters and public telephones, that tend to attract vandals and thieves. Real-time alarms alert the owners of these collection units when someone attempts to tamper with the units. This circuitry also allows remote detection of parking meter violations. The circuitry can be made to fit within standard parking meter housings and to remain hidden from view.

In one aspect, the invention features a slot antenna for use in transmitting radio frequency (RF) signals. The antenna is formed on a circuit board from a layer of conductive material from which some material has been removed to form a slot. A signal feed element, such as a coaxial cable terminating at a coaxial connector, connects electrically to the layer of conductive material on one side of the slot, and a conductive element extends from the signal feed element across the slot to connect to the layer of conductive material.

In some embodiments, the conductive material surrounds the slot entirely. In other embodiments, the slot has at least one serrated edge. In many antennas, the length of the slot is often selected to equal ½-wavelength at a selected transmission frequency, and the position of the feed element is selected to minimize return loss in the antenna.

In other embodiments, the antenna is shaped to fit within the space constraints of a particular type of enclosure, such as a parking meter. Some antennas are designed to replace the rate plates in conventional electronic parking meters and therefore include printed parking rate information on one surface.

In another aspect, the invention features an electronic parking meter having processing circuitry that gathers data about the parking meter and RF transmitting circuitry that modulates the data onto an RF carrier wave to form an RF signal. An RF antenna in the meter then transmits the RF signal. A housing, typically formed from a conductive metal, encloses the processing circuitry, the RF transmitting circuitry, and the RF antenna.

In another aspect, the invention features a parking meter rate plate, one surface of which includes printed parking rate information, and another surface of which includes an RF antenna. In some embodiments, the antenna is a slot antenna formed on a printed circuit board.

In yet another aspect, the invention features a technique for use in transmitting data from an electronic parking meter. The technique involves reading data from the meter electronically, modulating the data onto an RF carrier wave to form an RF signal, and delivering the RF signal to an RF antenna located within the parking meter.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
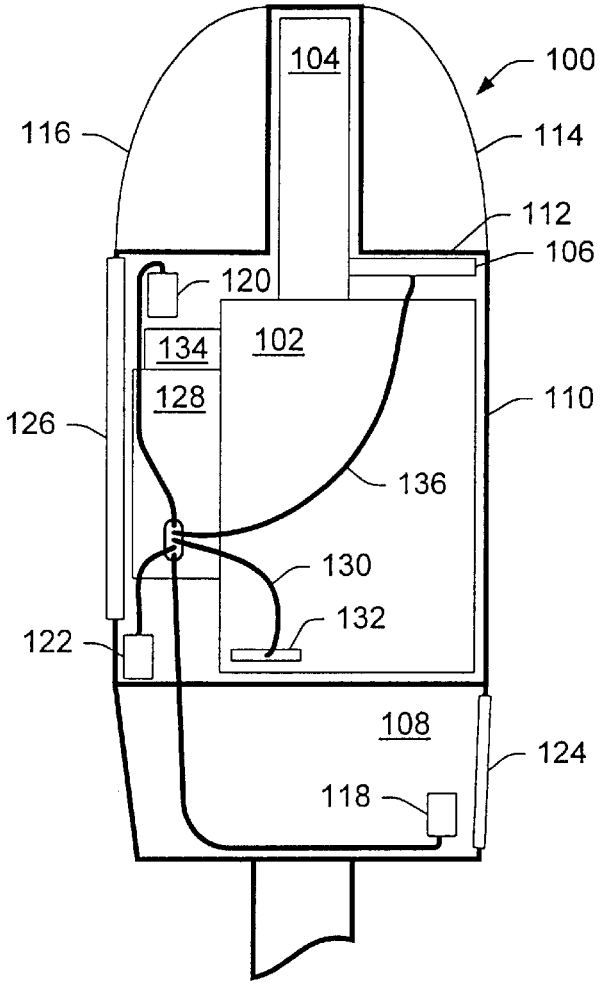
FIG. 1 shows a partial side view of an electronic parking meter with RF transmission circuitry.

FIG. 1 shows an electronic parking meter 100 having RF transmission circuitry that delivers information from the meter to remote locations. The meter 100 includes many of the components found in a conventional electronic parking meter, including an electronic metering mechanism 102 that monitors coin insertion and measures the time remaining until or elapsed since meter expiration. The electronic metering mechanism 102 also collects information about the parking meter 100, such as the amount of money deposited into the meter 100 since the meter was last emptied. The meter 100 also includes a display plate 104, or face plate, that provides a visual display of the amount of time remaining or elapsed, and a rate plate 106 that provides printed parking rate information. A coin vault 108 receives and holds coins deposited into the meter 100. All of these components are enclosed in a protective meter housing 110, which usually is formed from a rugged, conductive material, such as metal. An aperture 112, or window, in the meter housing 110 exposes the printed information on the rate plate 106. One or more clear glass or plastic covers 114, 116 protect the display plate 104 and the rate plate 106 from defacing by vandals and natural elements.

In some embodiments, the meter 100 also includes one or more motion sensors 118, 120, 122 that generate alarm signals when someone tampers with the meter 100. The types of sensors found in the meter include a vault sensor 118 that activates when a door 124 to the coin vault 108 is opened or jarred; a housing sensor 120 that activates when a door 126 to the meter housing 110 is opened or jarred; and a tilt sensor 122 that activates when someone attempts to move the meter 100.

The meter 100 also includes a data collection and transmission unit 128 within the meter housing 110. This unit 128, which usually mounts to the electronic metering mechanism 102, periodically polls the electronic metering mechanism 102 for information about the parking meter, including the amount of time remaining or elapsed and the amount of money in the vault. A cable 130 links the data collection and transmission unit 128 to a data port 132, such as an RS-232 serial port, in the electronic metering mechanism 102. A battery 134 provides power to the data collection and transmission unit 128. The data collection and transmission unit 128 also receives alarm signals generated by the motion sensors 118, 120, 122.

The data collection and transmission unit 128 transmits the information collected from the electronic metering mechanism 102 and the motion sensors 118, 120, 122 to remote locations over a wireless link, such as an RF link. A cable 136 links the data collection and transmission unit 128 to an antenna in the meter housing 110. In the example shown here, the antenna is located on the rate plate 106, as described below.

Figure 2:
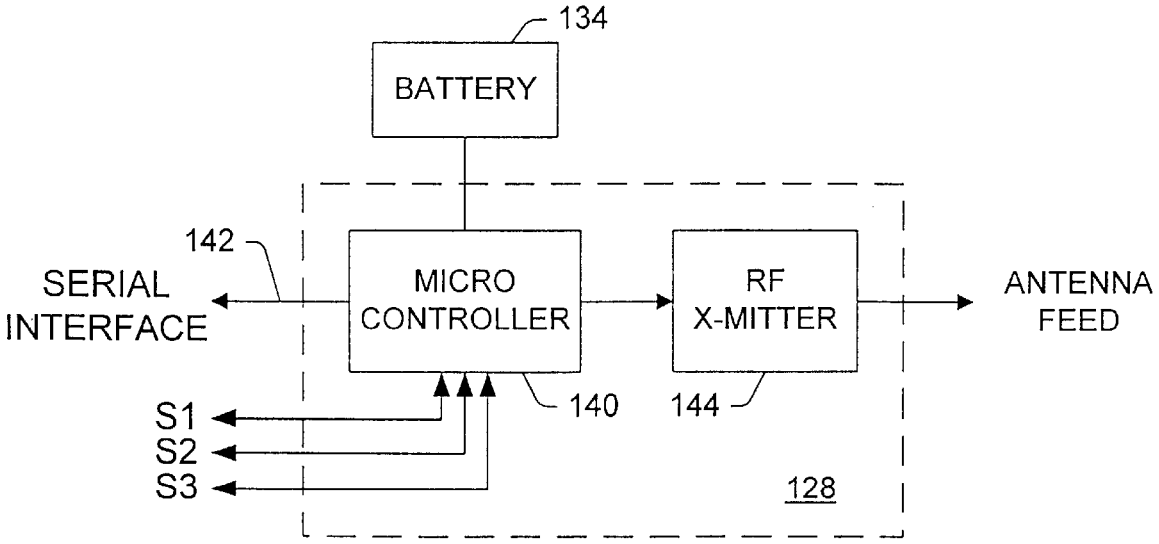
FIG. 2 is a block diagram of the RF transmission circuitry.

FIG. 2 shows the data collection and transmission unit 128 in more detail. The unit includes a microcontroller 140 ("controller") that links to the electronic metering mechanism 102 through a serial interface 142. The microcontroller 140 periodically polls the electronic metering mechanism 102 for information about the meter and delivers this information to an RF transmitter 144. The controller 140 also receives alarm signals SI, S2, S3 from the motion sensors, if any, in the meter. The controller 140 delivers the alarm signals S1, S2, S3 to the RF transmitter 144, along with information identifying which of the sensors generated the alarm signals. The RF transmitter 144 modulates the information onto an RF carrier waveform, such as a 917 MHz wave in the Industrial, Scientific, and Medical (ISM) band, and then feeds the RF signal to the antenna for transmission to remote locations.

Figure 3:
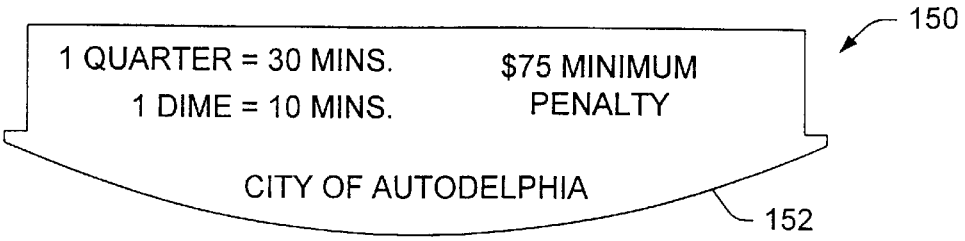
FIGS. 3, 4, 5, and 6 show parking meter rate plates that include RF antennas.
Figure 4:
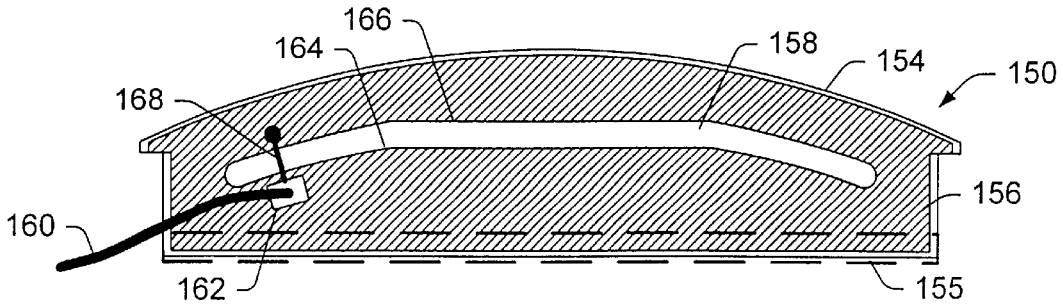

FIGS. 3 and 4 show opposite sides of a planar RF antenna 150 that also serves as a parking meter rate plate. In this example, the antenna 150 is a single-sided printed circuit board. One side 152 of the antenna 150 provides parking-related information to people wanting to use the parking meter. This side 152 is visible through the meter's glass cover. The other side 154 of the antenna 150, which is hidden from view, bears the antenna elements. This side 154 includes a layer of a conductive material 156, such as copper, having a slot pattern 158 etched into it. In this example, the conductive layer 156 extends near the edges of the circuit board. Some embodiments require the use of an electrically insulating material 155, such as a strip of insulating tape, along one or more edges of the antenna 150 to prevent short circuits from forming between the conductive material 156 and the meter housing.

In general, a slot length of ½-wavelength at the carrier frequency optimizes the antenna's output power level. For an antenna operating in the ISM band at 917 MHz, the optimal slot length in an FR-4 substrate is approximately 4.3 inches, as measured along a line that extends through the slot from one end of the slot to the other. Conductive material can be added to or removed from one end of the slot to optimize the antenna's power level in a particular parking meter.

The antenna is driven by a bipolar signal feed element, such as a coaxial cable 160 or a balanced two-wire line, that terminates at an SMMB connector 162, mounted to the printed circuit board near one edge 164 of the slot 158. One conductor of the cable 160 connects electrically to the conductive layer 156 at the connector 162 near the edge 164 of the slot 158. The other conductor of the cable 160 connects electrically to the conductive layer 156 near the other edge 166 of the slot 158. A conductive wire 168 spans the slot 158, linking the connector 162 and the cable 160 to the conductive material 156 near the other edge 166 of the slot.

In general, the antenna is designed to minimize return loss. Therefore, the antenna structure, including the position of the feed element, is optimized to match the input impedance of the antenna to the characteristic impedance of the feed element and to the air. When used in a metallic meter, the antenna's input impedance is affected by signal reflections from the surrounding enclosure. Placing the feed element near one end of the slot 158 (e.g., approximately 0.25 inches from the end of the slot in the example shown here) optimizes the antenna for use as a rate plate in a typical, commercially available parking meter. Conductive material can be added to or removed from one end of the slot as needed to tune the antenna for operation in a particular parking meter. The width of the slot also affects impedance matching. A slot width on the order of 0.1 inches is suitable for the example shown here. A typical parking meter rate plate is approximately 4.95 inches long and approximately 1.25 inches wide.

Figure 5:
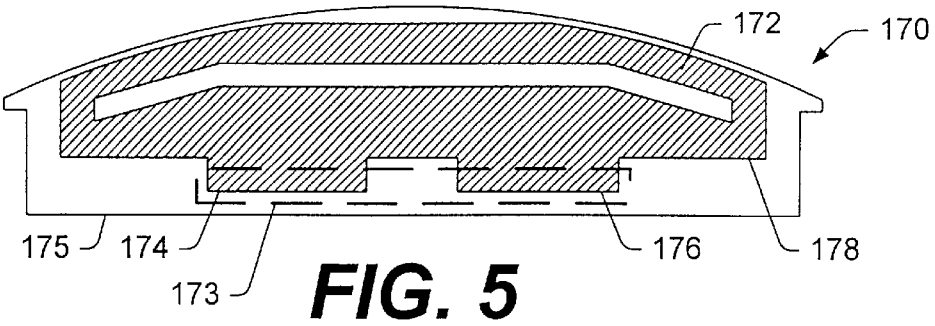
Figure 6:
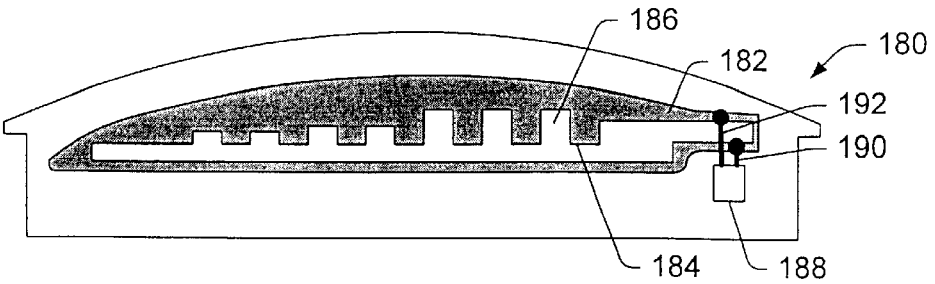

FIGS. 5 and 6 show alternative slot antennas. The antenna 170 of FIG. 5 includes a patterned layer of conductive material 172 that leaves much of the printed circuit board bare. In some embodiments, the pattern includes legs 174, 176 that extend from one edge 178 of the conductive layer toward an edge 175 of the circuit board. A layer of insulating material 173, such as insulating tape, can be placed over the legs 174, 176 to prevent shorts from forming between the antenna 170 and the meter housing.

The antenna 180 of FIG. 6 includes a patterned conductive layer 182 that is serrated along one edge 184 of the slot 186. This antenna 180 also includes a signal feed element 188 that mounts to a bare portion of the circuit board instead of to the conductive layer 182. Two conductive elements 190, 192 connect the signal feed element 188 to the conductive layer 182 on opposite sides of the slot 186. In some parking meters, patterned conductive layers such as those shown in FIGS. 5 and 6 improve the impedance matching characteristics and tuning characteristics of the antennas.

A number of embodiments of the present invention have been described. Nevertheless, it will be understood that various modifications can be made without departing from the spirit and scope of the invention. For example, while the invention has been described in terms of a parking meter, data collection and RF transmission circuitry like that described above is useful in other applications as well, including public telephones, newspaper dispensers, and vending machines. Moreover, in some parking meters, the antennas are located behind the display plates or on the data collection and transmission units. One advantage to placing the antenna on the rate plate is that RF signals transmitted from the antenna are close to the aperture in the meter housing. Antennas, other than slot antennas, also are used in some implementations. For example, in some embodiments, loop antennas mounted to solid sheets of conductive material are placed behind the meters, display plates. Accordingly, other embodiments are within the scope of the following claims.

What is claimed is:

1. A slot antenna for use in transmitting radio frequency (RF) signals, the antenna comprising:

(a) a circuit board having a layer of conductive material from which a portion of the conductive material has been removed to form a slot;

(b) a signal feed element connected electrically to the layer of conductive material on one side of the slot; and (c) a conductive element extending from the signal feed element across the slot to connect to the layer of conductive material.

2. The antenna of claim 1, wherein the conductive material surrounds the slot entirely.

3. The antenna of claim 1, wherein the slot has a length approximately equal to ½-wavelength at a selected transmission frequency.

4. The antenna of claim 1, wherein the signal feed element is positioned to minimize return loss in the slot antenna.

5. The antenna of claim 1, wherein the signal feed element comprises a coaxial connector.

6. The antenna of claim 1, wherein the circuit board is shaped to fit within the space restraints of a conductive enclosure.

7. The antenna of claim 1, wherein the circuit board is shaped to fit into a parking meter housing.

8. A rate plate for a parking meter comprising a planar element having:

(a) one surface that includes printed parking rate information; and (b) another surface that includes an RF antenna.

9. The rate plate of claim 8, wherein the planar element comprises a printed circuit board.

10. The rate plate of claim 9, wherein the RF antenna includes a layer of conductive material and a portion of the conductive material has been removed to form a slot.

11. The rate plate of claim 10, further comprising a signal feed element connected electrically to the layer of conductive material on two sides of the slot.

12. A rate plate for a parking meter comprising: a printed circuit board having a layer of conductive material on a first side thereof from which a portion of the conductive material has been removed to form a slot with a signal feed element connected electrically to the layer of conductive material on two sides of the slot to form an antenna, and parking rate information located on a second side of the printed circuit board.

13. A slot antenna for use in transmitting radio frequency (RF) signals, the antenna comprising:

(a) a circuit board having a layer of conductive material from which a portion of the conductive material has been removed to form a slot, the slot having at least one serrated edge;

(b) a signal feed element connected electrically to the layer of conductive material on one side of the slot; and (c) a conductive element extending from the signal feed element across the slot to connect to the layer of conductive material.

14. A rate plate for a parking meter comprising:

(a) a circuit board having one surface that includes printed parking rate information; and (b) another surface that includes an RF antenna, the another surface including a layer of conductive material from which a portion of the conductive material has been removed to form a slot, a signal feed element connected electrically to the layer of conductive material on one side of the slot, and a conductive element extending from the signal feed element across the slot to connect to the layer of conductive material.

15. The antenna of claim 14, wherein the circuit board is shaped such that the surface of the circuit board that includes the printed parking information is visible to a human user when the circuit board is installed in a parking meter.

* * * * *